US005353037A

United States Patent [19]

Jones

[11] Patent Number: 5,353,037

[45] Date of Patent: Oct. 4, 1994

[54] SYSTEM FOR DEICING DISH MOUNTED ANTENNAE

[76] Inventor: Thad M. Jones, 1302 High St., South Bend, Ind. 46601

[21] Appl. No.: 1,187

[22] Filed: Jan. 7, 1993

Related U.S. Application Data

[63] Continuation of Ser. No. 829,504, Feb. 3, 1992, abandoned.

[51] Int. Cl.[5] ..... H01Q 1/02

[52] U.S. Cl. ..... 343/704; 392/422

[58] Field of Search ..... 343/704, 912, 720, 840; 392/426, 427, 428, 429, 422; H01Q 1/02

[56] References Cited

U.S. PATENT DOCUMENTS 3,079,912 3/1963 Griem ..... 126/390

4,866,452 9/1989 Barma et al. ..... 343/704

5,010,350 4/1991 Lipkin et al. ..... 343/704

*Primary Examiner*—Donald Hajec

*Assistant Examiner*—Hoanganh Le

*Attorney, Agent, or Firm*—R. Tracy Crump

[57] ABSTRACT

A appartus for deicing a reflector type microwave antenna. The appartus includes an infrared generator placed behind the antenna dish and a paraboloidal reflector. The infrared generator acts as a point source at the focal point of the paraboloidal reflector emitting radiant energy away from the antenna dish onto a paraboloidal reflector. The paraboloidal reflector reflects the radiant energy parallely to the principal axis of the reflector onto the rear surface of the antenna dish to uniformly heat the antenna dish.

11 Claims, 5 Drawing Sheets

SYSTEM FOR DEICING DISH MOUNTED ANTENNAE

This is a continuation-of-application Ser. No. 07/829,504, filed Feb. 3, 1992, now abandoned.

BACKGROUND OF THE INVENTION

This invention relates to an apparatus for deicing an antenna reflector.

During winter season, snow and ice often accumulate on the dish reflectors of satellite earth stations and microwave antennas. Since water is a dielectric, accumulation of ice and snow reduce the performance of these antenna dishes. Antenna dishes that use fixed low power levels and high frequencies signals with short wavelengths, for example satellite communication antennas, are particularly susceptible to the problems of ice and snow accumulation.

Various ice resistant and ablative chemical coatings have been developed to prevent ice and snow from forming and accumulating on antenna dishes. Chemical compounds, such as isopropyl alcohol, urea, ethylene, and propylene glycol, reduce moisture buildup by lowering the freezing point of water. Chemical coatings, however, have not provided adequate protection and often cause secondary problems, including environmental hazards, fires and excess cost. For maximum effectiveness, chemicals must be applied to the antenna reflector prior to the accumulation of the ice and snow. Coating tends to coalesce water into droplets, when the droplets increase to a critical size, they flow off the antenna reflector. In freezing temperatures, these droplets may freeze and aggravate the problem. The coatings are not effective at extremely low temperatures and have a limited life span.

Teflon coated glass fabrics used as a reflector covers or radomes have been developed to prevent ice from developing a strong enough bond for adhesion. This type of surface covering is effective only for a few seasons. Eventually, the sun's ultraviolet radiations causes cracks to form in the Teflon surface which allows the ice to bond to the surface.

For economic reasons, heating the reflector dish to prevent the accumulation of ice and snow represents the most effective solution. Common thermal deicing techniques employ the principles of conduction, convention and infrared radiation. The cost and reliability of each technique depends upon the design of the antenna reflector, including support members, and skill of designers. Convection deicing employs either electric heaters or a furnace burning gas, LPG, propane, etc. Convection heating theoretically heats the reflector uniformly. This prevents thermal stress distortion of the antenna reflector. Distortion alters the radiation characteristics of the antenna in an unpredictable manner. In satellite communications, the FCC's two degree satellite spacing requires a tight side-lobe specification to prevent interference with adjacent satellites. Even minor distortion can cause an antenna to exceed the maximum side-lobe specification.

In practice, convection systems seldom attain theoretical performance levels. Inadequate and poor air flow through the ducts causes temperature gradients. Convection systems also tend to be expensive and complex, since they employ high temperature heaters and blowers which require continual maintenance.

Conduction systems employ heaters bonded directly to the rear of the antenna reflector. Conduction systems generally have a low initial cost, but suffer from a short service life and objectionable temperature gradients. Conduction systems employing self-regulating heaters are usually more effective and reliable than those using constant wattage heaters. Reliable bonding of the heater to the rear surface of the antenna reflector is a major problem with conduction heaters. When the bond begins to fail, heat transfer is inhibited, which causes the heater to operate at higher temperatures. These high temperatures accelerate the bonding failures and ultimately, the heater temperature attains a level that destroys the bond completely. Self-regulating heaters compensate for these bonding failures. As the bond deteriorates, the heater temperature never reach destructive levels.

Heater failures create intolerable problems. First, locating the defective heater is an exceptionally difficult problem. After the defective heater is located, installing its replacement requires removing insulation and the defective heater. Proper heater re-bonding and insulation replacement may require the return of the entire antenna dish back to the factory.

U.S. Pat. No. 4,866,452 issued to Barma and assigned to Raychem uses an antenna dish with self-regulating infrared heaters bonded to black aluminum panels. The panels are mounted to the rear cover of the antenna dish or positioned at an intermediate point between the cover and the rear of the antenna dish. The panel emits infrared radiation of a long wavelength into the antenna reflector. The infrared radiation from the heaters is directed onto the black aluminum panels to de-ice the antenna dish.

U.S. Pat. No. 5,010,350 issued to Lipkin discloses paraboloidal reflector-type microwave antenna dish which has an infrared energy generator located on but not behind the rear side of the antenna. The infrared energy is directed unto the rear side of the antenna dish, the energy rear side of the infrared energy source is not radiated onto the rear side of the antenna dish. A polished surface on the rear (the side away from the antenna, not toward the antenna) of the infrared source directs almost all of the radiation onto the rear of the antenna dish. The polished surface is also not parabolic. Further, the infrared source is not collimated by the lens and thus does not provide parallel rays for the rear of the antenna reflector.

U.S. Pat. No. 3,173,141 issued to Bowman introduces a concentrated beam of heat energy, preferably infrared energy, into a small aperture located in the R-F shadow of the horn. The infrared energy will strike the radome surface at a small angle of incidence, and therefore effect appreciable heat transfer.

SUMMARY OF THE INVENTION

The deicing apparatus of this invention uses an infrared heat source and a paraboloidal reflector to uniformly heat the rear surface of an antenna dish. The infrared heat source or generator emits short to medium wavelengths of infrared .radiation in an initial direction away from the antenna dish. The infrared generator is positioned behind the antenna dish on the principal axis of paraboloidal reflector to act substantially as a radiation emitting point surface. The heat source initially emits radiation away from the antenna dish onto a concave inner reflective surface of the paraboloidal reflector. The paraboloidal reflector redirects the infrared radiation onto the rear surface of the antenna dish parallely to the reflector's principle axis. The reflected parallel radiation provides substantially even heat distribution across the rear surface of the antenna dish, which prevents distortion in the antenna dish. Using the infrared generator and paraboloidal reflector, the deicing apparatus of this invention eliminates the need to enclose or insulate the deicing apparatus as found in convection systems. This invention also eliminates the bonding and temperature regulation problems of conduction systems.

Accordingly, an object of this invention is to provide for a novel and unique deicing apparatus for an antenna dish.

Another object of this invention is to provide a practical and economic deicing apparatus for uniformly heating an antenna dish.

Another object of this invention is to provide a deicing apparatus using an infrared radiation emitting generator and a paraboloidal reflector for reflecting infrared radiation from the generator onto an antenna dish parallely to the reflector's peripheral axis.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENTS

The preferred embodiments herein described are not intended to be exhaustive or to limit the invention to the precise forms disclosed. It is chosen and described to explain the principles of the invention and its application and practical use so that others skilled in the art may follow its teachings.

Figure 1:
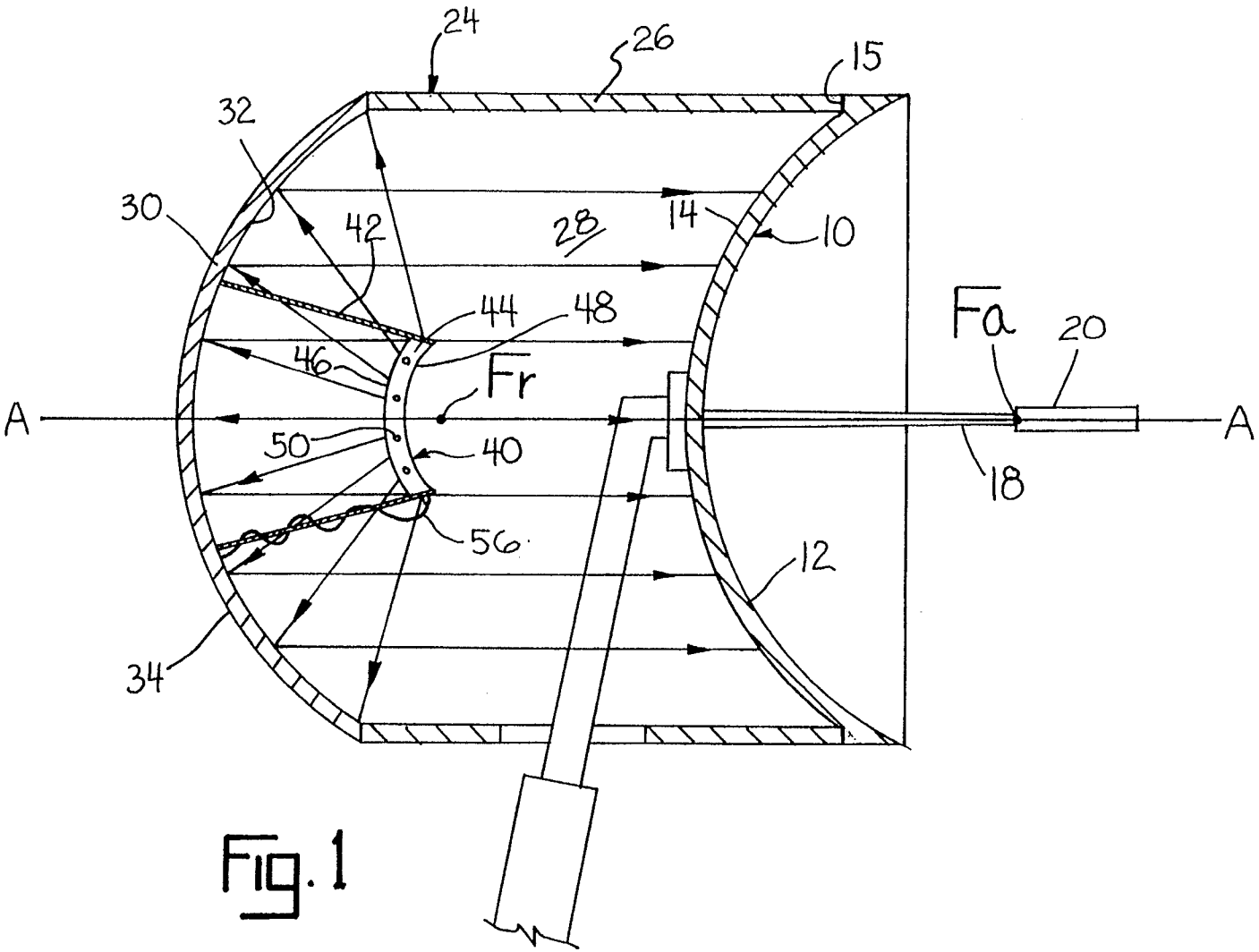
FIG. 1 is a sectional view of a dish showing an antenna dish with the deicing apparatus of this invention and antenna dish.

FIG. 1 shows antenna dish 10. Antenna dish 10 has generally a paraboloidal shape with concave front surface 12 and convex rear surface 14. Signal receiver 20 positioned at focal point $F_a$ of antenna dish 10 is supported by arm 18 extending from front surface 12. Collimator housing 24 is mounted by any conventional method behind antenna dish 10 along the outer edge 15 of antenna dish 10. Collimator housing 24 includes reflector 30 and cylindrical side walls 26, which define an enclosed area 28. The deicing apparatus of this invention use a radiation method of heat transfer rather than a conduction or convection method; therefore, collimator housing 24 does not need to be enclosed, sealed or insulted unless convenient. Side walls 26 can be constructed from a variety of conventional materials. Side walls 26 prevent debris from accumulating inside enclosed area 28 and prevent birds and animals from entering enclosed area 28.

Reflector 30 has a paraboloidal shape with a concave inner surface 32 and a convex outer surface 34. The curvature of reflector 30 follow the standard mathematical equation of a $$\frac{y^2}{a^2} + \frac{z^2}{b^2} = 2CX$$

paraboloid (where a, b and c are constants determinable for any particular application and a principal axis A—A corresponds to the x axis). Reflector 30 has a focal point $F_r$, located along principal axis A—A. The paraboloidal contour of reflector 30 is a key factor in providing uniform heating of antenna dish 10. Inner concave surface 32 of reflector 30 acts as an infrared optically reflective surface. Inner surface 32 can be polished to provide the desired reflective properties or covered with a smooth infrared reflective material, such as adhesive backed aluminum foil.

As shown in FIG. 1, diffused infrared heat generator 40 is supported within enclosed area 28 behind rear surface 14 of antenna dish 10 by generator legs 42. Generator 40 is connected to legs 42 and reflector 30 by any conventional method such as screw bolt weld. Generator 40 includes a serpentine heater coil 50 which is preferably enclosed in casting 44 of high temperature metal alloy such as aluminum similar in construction 50 an electric frying pan. Heater coil 50 is preferably formed of nichrome wire 52 surrounded by magnesium oxide insulation 54. Voltage for operating generator 40 is supplied through power cord 56. Embedding heater coils 50 in aluminum casting 44 improves the efficiency of generator 40. The high thermal conductivity of the aluminum reduces temperature gradients to enhance temperature uniformity and increase efficiency.

Generator 40 is oriented to radiate all its energy toward inner concave surface 32 of reflector 30 away from antenna dish 10. Casting 44 has front face 46 coated with a high emissivity material. Front face 46 of generator 40 allows direct emission of the infrared radiation toward reflector 30. Depending upon the efficiency desired, front face 46 may be anodized or painted black. Rear face 48 of casting 44 is polished with an anti-radiation coating of low emissivity. Any conventional method of producing a low emissivity and reflective property on rear face 48 can be used including, polishing and clear anodizing. Rear face 48 of generator 40 blocks or prevents any radiation emitted from coils 50 in the direction toward antenna dish 10.

Figure 2:
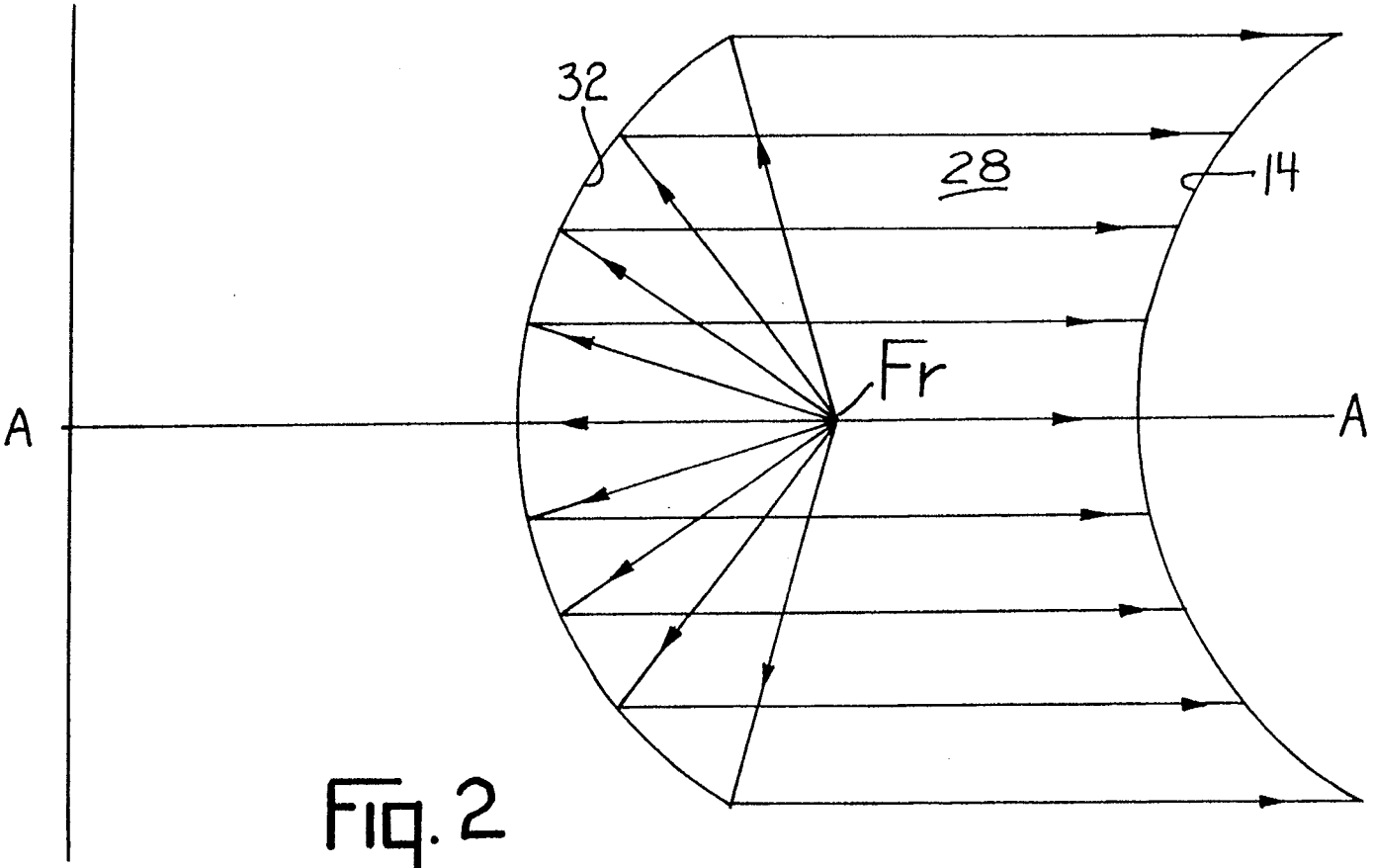
FIG. 2 is a sectional view of the parabolic inner surface of the deicing apparatus and the rear surface of the antenna dish which illustrates infrared radiation emitted from a point source located at the focal point of a parabolic surface reflected parallely of parabolic surface along the principle axis.

The positioning of generator 40 with area 28 provides the desired uniform heating of antenna dish 10. Generator 40 is centered about principal axis A—A to act as an infrared point source emitting radiation from focal point $F_r$. FIG. 2 illustrates the optical principle of the deicer apparatus of this invention. Radiation emitted from focal point $F_r$ toward inner concave surface 32 of reflector 30 as incident rays are reflected parallely to principal axis A—A towards rear surface 14 of antenna dish 10. The reflected parallel radiation uniformly heats antenna dish 10.

Figure 3:
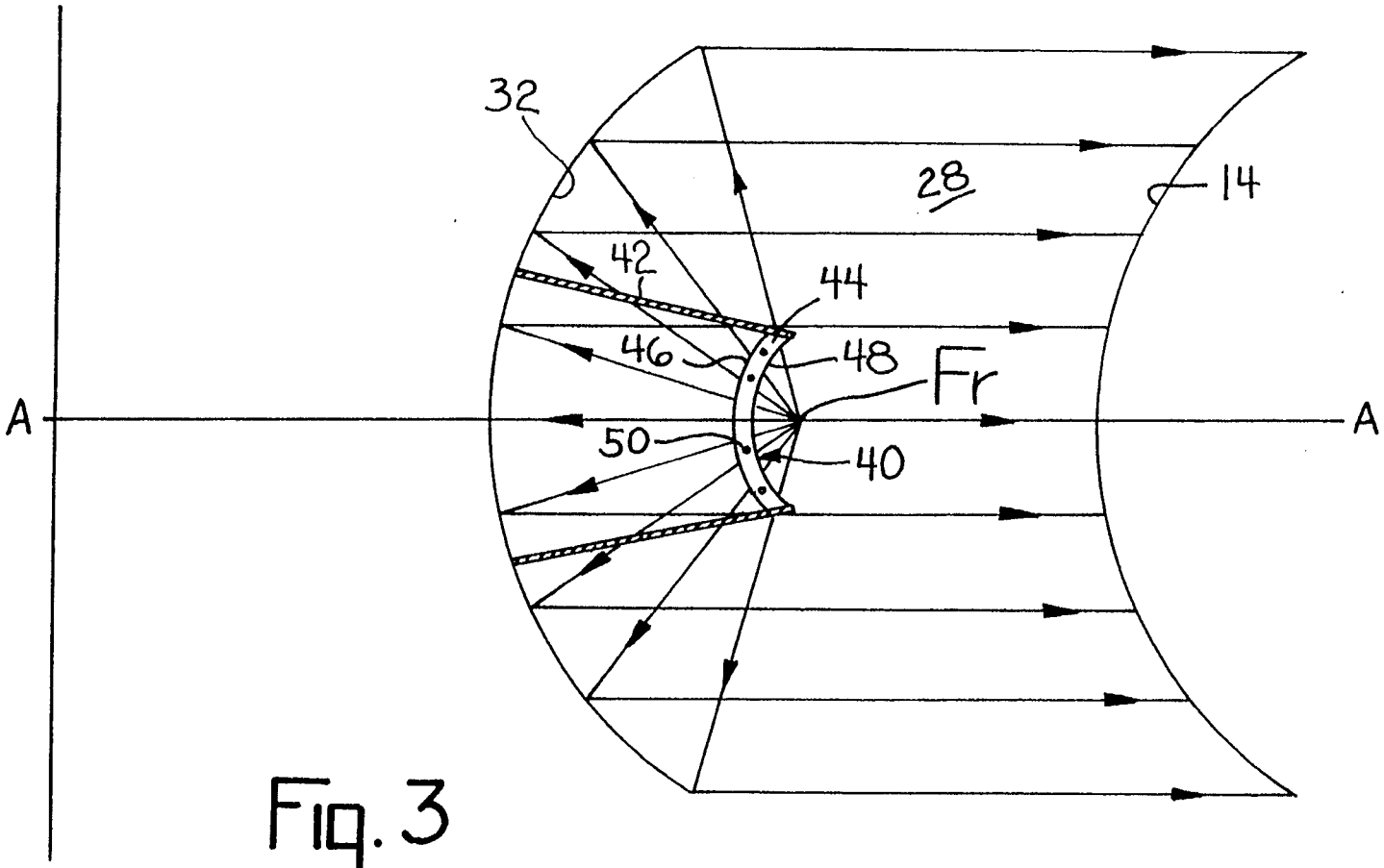
FIG. 3 is a sectional view of the parabolic inner surface of the deicing apparatus and the rear apparatus surface of the antenna dish which illustrates the infrared generator emitting radiation as a point source at the focal point of a parabolic surface.
Figure 4:
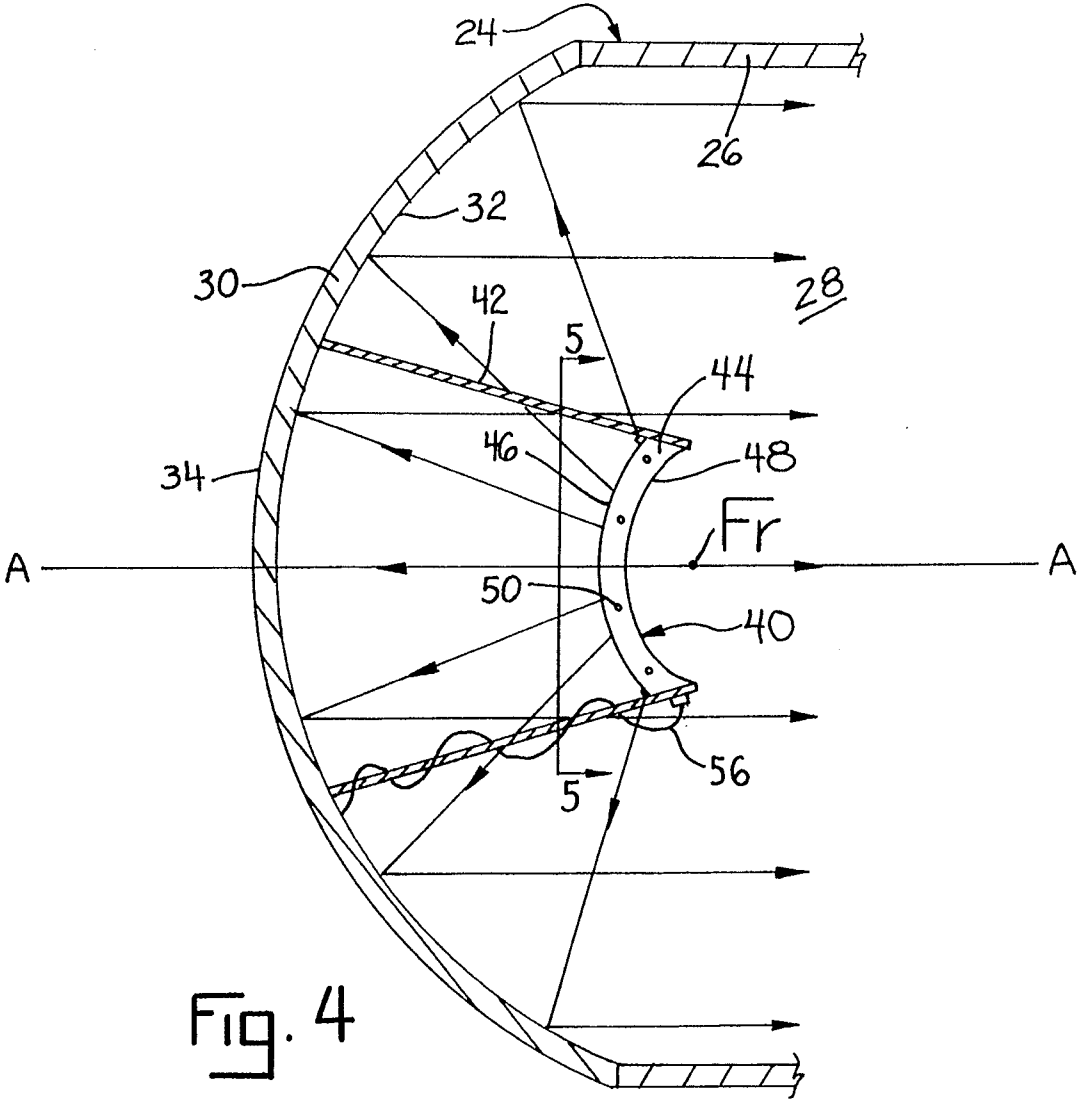
FIG. 4 is a fragmentary view of the infrared generator and the parabolic reflector .
Figure 5:
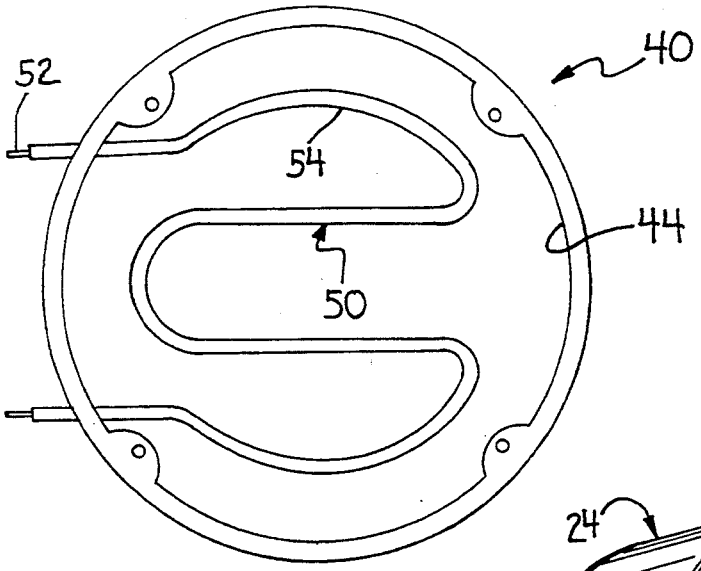
FIG. 5 is a plan view of the infrared generator of FIG. 2 as seen from line 5—5 of FIG. 4.
Figure 7:
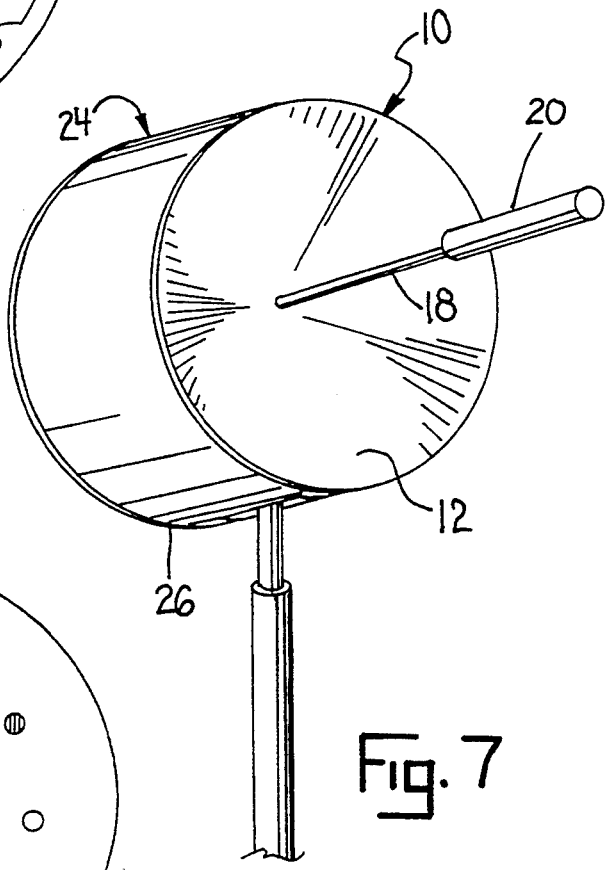
FIG. 7 is a perspective view of the dish and deicing system.
Figure 6:
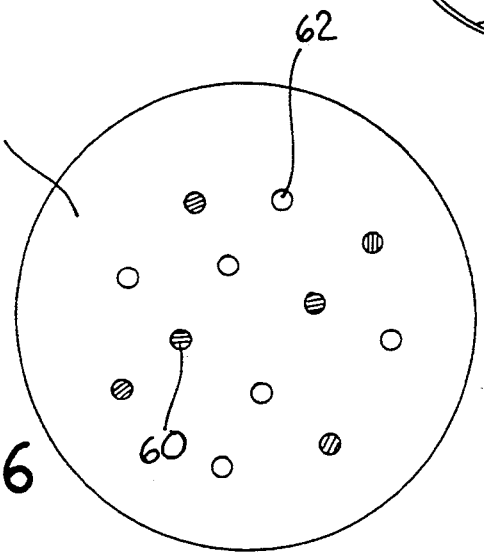
FIG. 6 is a rear view of the rear surface of the antenna dish.

As illustrated in FIGS. 1, 3 and 4, generator 40 is located between focal point $F_r$ and inner concave surface 32. The outer boundary of generator 40 extend to a point along a line connecting focal point $F_r$ to the outer rim of inner concave surface 32. As the distance between generator 40 and focal point $F_r$ increases, generator 40 must be formed of a larger diameter to emit infrared radiation along the outer most incident ray found on the line between focal point $F_r$ and the outer rim of inner concave surface 32. This allows the infrared radiation to be reflected uniformly and substantially parallel to principal axis A—A onto rear surface 14 of antenna dish 10. The figures also show casting 44 formed in a hyperoidal shape, which allows the infrared radiation to be emitted as if from a single point source at focal point $F_r$. Since the de-icer apparatus of this invention is not image forming; therefore, generator 10 need not be a point source located at focal point $F_r$ or incorporate a hyperbolic shaped inner surface 48 as is the case with Cassigrain optics, unless this is convenient. The diameter of generator 10 is preferably at least 110% of the distance between the outer boundary of coils 50 and the outer rim of inner surface 32, and preferably not exceed 25% of the diameter of reflector 30 or antenna dish 10, whichever is smaller.

Improper positioning of generator 10 may create areas of unequal thermal transfer or cold spots on the rear surface of antenna dish 10. Infrared absorbent paint 60 having the proper absorbivity may be applied to rear surface 14 of antenna dish 10 to increase the absorption rate of the infrared radiation at a cold spot. An absorbent coating may also be applied to the entire rear surface of the antenna dish to reduce the energy required to heat the rear surface and thereby reduce the efficiency of the infrared heating source. Likewise, if hot spots exist on the rear side of the antenna dish 10, infrared reflecting paint 62 of proper reflectivity may be applied to the hot spot to lower infrared absorption and lower the temperature of the spot to that other of the rear surface of the antenna dish 10.

It is understood that the above description does not limit the invention to the given details, but may be modified within the scope of the following claims.

I claim:

1. An apparatus for deicing an antenna dish having a front surface and a rear surface, said apparatus comprising:

paraboloidal reflector means located behind said dish rear surface for reflecting radiation onto said dish rear surface to uniformly heat said antenna dish, radiant heating means located between said paraboloidal reflector means and said dish rear surface for emitting said radiation towards said paraboloidal reflector means, said paraboloidal reflector means having a principal axis and a focal point located on said principal axis, said heating means positioned on said principal axis between said paraboloidal reflector means and said focal point wherein said paraboloidal reflector means reflects said radiation emitted from said heating means substantially parallel to said principal axis onto said dish rear surface.

2. The apparatus of claim 1 wherein said paraboloidal reflector means includes an outer edge, said heating means having an outermost dimension, said heating means positioned on said principal axis with its said outermost dimension lying on a line between said outer edge of said paraboloidal reflector means and said focal point.

3. The apparatus of claim 1 wherein said paraboloidal reflector means is a mirror.

4. The apparatus of claim 1 wherein said heating means has a front face facing said paraboloidal reflector means and a rear face facing said dish rear surface, said heating means rear face coated with a low emissivity radiation absorbing material to prohibit emission of said radiation directly from said heating means toward said dish rear surface.

5. The apparatus of claim 1 wherein said heating means is an infrared heat generator.

6. The apparatus of claim 1 and a support connected between said paraboloidal reflector means and said heating means, said support constituting means for securing said heating means to said reflector means.

7. The apparatus of claim 1 wherein said dish rear surface includes a radiation absorption reducing compound applied to selected areas of said dish rear surface.

8. The apparatus of claim 1 and a housing connected between said reflector means and said dish, and housing enclosing said heating means and said dish rear surface.

9. The apparatus of claim 1 wherein said dish rear surface includes a radiation absorption enhancing compound applied to selected areas of said dish rear surface.

10. The apparatus of claim 9 wherein said radiation absorption enhancing compound is applied to the entire rear surface of said dish.

11. The apparatus of claim 1 wherein said heating means emits said radiation towards said paraboloidal reflector means as originating substantially from said focal point.

* * * * *